US010786745B2

(12) United States Patent
Chan et al.

(10) Patent No.: US 10,786,745 B2
(45) Date of Patent: Sep. 29, 2020

(54) TOY DOLL WITH MOVABLE PORTION

(71) Applicant: Mattel, Inc., El Segundo, CA (US)

(72) Inventors: Patricia Chan, Redondo Beach, CA (US); Guo Lin Zhou, Guangdong (CN); Steven D. Ryniker, Torrance, CA (US)

(73) Assignee: Mattel, Inc., El Segundo, CA (US)

( * ) Notice: Subject to any disclaimer, the term of this patent is extended or adjusted under 35 U.S.C. 154(b) by 956 days.

(21) Appl. No.: 14/262,239

(22) Filed: Apr. 25, 2014

(65) Prior Publication Data

US 2014/0329435 A1 Nov. 6, 2014

Related U.S. Application Data

(60) Provisional application No. 61/818,989, filed on May 3, 2013, provisional application No. 61/861,650, filed on Aug. 2, 2013.

(51) Int. Cl.

| | |
|---|---|
| ***A63H 3/46*** | (2006.01) |
| ***A63H 3/36*** | (2006.01) |
| ***A63H 3/20*** | (2006.01) |

(52) U.S. Cl.

CPC ..... *A63H 3/36* (2013.01); *A63H 3/20* (2013.01)

(58) Field of Classification Search

USPC ..... 446/321, 330, 331, 378, 379, 380

See application file for complete search history.

(56) References Cited

U.S. PATENT DOCUMENTS

| | | | | |
|---|---|---|---|---|
| 1,148,540 | A | 8/1915 | Sancier | |
| 1,259,782 | A | 3/1918 | Savage | |
| 1,396,766 | A | 11/1921 | McClelland | |
| 1,407,165 | A | 2/1922 | Pajeau | |
| 1,567,661 | A | 12/1925 | Levaggi et al. | |
| 1,784,369 | A | 12/1930 | Lowenbaum | |
| 1,886,442 | A * | 11/1932 | Wimmer | A63H 13/02 446/338 |
| 1,966,986 | A | 7/1934 | Martin | |
| 2,195,127 | A | 3/1940 | Brucker | |
| 2,219,311 | A * | 10/1940 | Hammond | A63H 33/20 446/51 |
| 2,274,303 | A | 2/1942 | Ornstein | |
| 2,277,882 | A * | 3/1942 | Quady | A63H 33/20 446/51 |
| 2,325,750 | A | 8/1943 | De Vries | |
| 2,825,905 | A | 3/1958 | Merl | |
| 3,377,740 | A * | 4/1968 | Bonanno | A63H 3/48 446/330 |

(Continued)

FOREIGN PATENT DOCUMENTS

GB 2303077 A 12/1997

*Primary Examiner* — Joseph B Baldori

(74) *Attorney, Agent, or Firm* — Edell, Shapiro & Finnan, LLC

(57) ABSTRACT

A toy doll with a movable portion is a toy doll with a first portion and a second portion that is movably coupled to the first portion and movable between a first configuration and a second configuration. The first portion includes a trigger that may actuate at least one of an engagement assembly and a hinge assembly. The engagement assembly may retain the second portion in the first configuration until the trigger is actuated while the hinge assembly may move the second portion of the toy doll to the second configuration.

20 Claims, 12 Drawing Sheets

(56) References Cited

U.S. PATENT DOCUMENTS 3,724,125 A 4/1973 Goldfarb et al.
3,758,982 A * 9/1973 Lemelson ..... A63H 13/00 446/365
3,797,166 A * 3/1974 Murray ..... A63H 3/48 446/320
3,851,419 A 12/1974 Kaelin
3,906,661 A * 9/1975 Weiser ..... A63H 3/20 446/333
4,008,541 A * 2/1977 Russer ..... A63H 33/20 446/51
4,030,239 A * 6/1977 White ..... A63H 3/48 446/321
4,107,873 A 8/1978 Bauer
4,168,592 A 9/1979 Merino
4,227,264 A 10/1980 Spector et al.
4,307,533 A 12/1981 Sims et al.
4,336,665 A 6/1982 Moreau
4,512,690 A 4/1985 Johnson
4,568,304 A 2/1986 Santa Maria
4,575,349 A 3/1986 Piazza et al.
4,610,639 A 9/1986 Piazza
4,639,233 A 1/1987 Brassfield
4,867,729 A * 9/1989 Weinman ..... A63H 3/20 428/3
4,921,459 A 5/1990 Cook et al.
5,011,445 A 4/1991 Nakasuji et al.
5,046,986 A * 9/1991 Wood ..... A63H 3/52 2/69
5,127,107 A 7/1992 Wood et al.
5,149,289 A 9/1992 Edwards et al.
5,167,562 A 12/1992 Axtell
5,186,673 A 2/1993 Fogarty et al.
5,224,894 A 7/1993 Nelson et al.
5,238,437 A * 8/1993 Vowles ..... A63H 33/28 446/15
5,277,645 A 1/1994 Kelley et al.
5,328,400 A 7/1994 Bass
5,503,583 A 4/1996 Hippely et al.
5,588,895 A 12/1996 Larson
5,842,905 A 12/1998 Lee et al.
5,868,598 A 2/1999 Dinovo
6,012,962 A 1/2000 Arriola
6,132,285 A * 10/2000 Feldman ..... A63H 3/20 446/250
6,224,456 B1 * 5/2001 Wittenberg ..... A63H 3/20 446/330
6,280,281 B1 8/2001 Unalp
6,425,796 B1 * 7/2002 Gaynor ..... A63H 3/28 40/419
6,557,175 B2 5/2003 Greenblatt
6,736,692 B1 5/2004 Hoyos-Zermeno et al.
6,857,930 B1 * 2/2005 Lawley, Jr. ..... A63H 17/006 206/427
6,962,517 B2 11/2005 Murray
7,575,496 B2 * 8/2009 Lau ..... A63H 3/46 446/308
7,727,043 B2 6/2010 Whitaker
8,128,450 B2 3/2012 Imai
8,133,090 B2 * 3/2012 Hardin ..... A63H 3/00 40/411
8,376,805 B2 * 2/2013 Komorous-Towey .... B32B 3/08 446/175
8,684,782 B2 * 4/2014 Fiore ..... A63H 33/004 446/268
8,777,688 B2 * 7/2014 Barthold ..... A63H 11/00 446/330
8,944,877 B2 * 2/2015 Higuchi ..... A63H 3/36 446/268
2003/0087580 A1 5/2003 Shibahashi et al.
2005/0164598 A1 7/2005 Kelsey
2006/0111013 A1 * 5/2006 Lau ..... A63H 3/20 446/308
2006/0234599 A1 * 10/2006 Mo ..... A63H 3/50 446/97
2006/0281387 A1 12/2006 Mcmahan et al.
2006/0292965 A1 12/2006 Strauss
2007/0155280 A1 7/2007 Patean et al.
2009/0075555 A1 * 3/2009 Barthold ..... A63H 11/00 446/330
2009/0253347 A1 * 10/2009 Byrd ..... A63H 13/02 446/321
2009/0264045 A1 * 10/2009 Hardin ..... A63H 3/50 446/330
2010/0093254 A1 4/2010 Jung
2011/0111669 A1 5/2011 Chan et al.
2011/0250818 A1 10/2011 Geurts
2012/0045960 A1 2/2012 Kane et al.
2012/0052764 A1 * 3/2012 Chan ..... A63H 3/52 446/321
2012/0071060 A1 3/2012 Cannon
2012/0142249 A1 * 6/2012 Chan ..... A63H 3/28 446/321
2013/0288564 A1 * 10/2013 Chan ..... A63H 3/52 446/319
2014/0329435 A1 * 11/2014 Chan ..... A63H 3/36 446/376
2015/0079874 A1 * 3/2015 Strauss ..... F41B 3/03 446/308

* cited by examiner

TOY DOLL WITH MOVABLE PORTION

CROSS-REFERENCE TO RELATED APPLICATION

This application claims priority to and the benefit of U.S. Provisional Patent Application No. 61/818,989, filed May 3, 2013, entitled "A Toy Doll with Movable Portion," and claims priority to and the benefit of U.S. Provisional Patent Application No. 61/861,650, filed Aug. 2, 2013, entitled "A Toy Doll with Movable Portion." The entire disclosure of each of the two above-identified U.S. provisional patent applications is incorporated herein by reference in its entirety.

FIELD OF THE INVENTION

The present invention relates to a toy with a trigger actuated movable portion. More specifically, the present invention relates to a toy doll, insofar as "toy doll" includes any toy figurine, that has one or more movable portions that are movable in response to actuation of a trigger included on the toy doll.

BACKGROUND OF THE INVENTION

Toys, such as toy dolls, with movable or actuatable features have been and continue to be a stable source of amusement for children. With regards to dolls, any enhancements, accessories, and features that spark a child's imagination and provide continued engagement of the toy doll with the child, add to a doll's play value and build a bond between the child and the toy doll. In light of the above, there is a need for toys with creative, movable play features, and in particular, there is a need for a toy doll with a visually stimulating play feature to capture a child's attention and increase the play value of the toy doll.

SUMMARY OF THE INVENTION

According to at least one embodiment of the present invention, a toy with a movable portion is a toy doll that includes a first portion including a trigger, a garment coupled to the first portion and movable relative to the first portion between a first configuration and a second configuration, and an engagement assembly. The engagement assembly is movably coupled to the first portion and configured to releasably couple the first portion to the garment. The engagement assembly is movable between an engaged position and a disengaged position, such that the engagement assembly is configured to couple the garment to the first portion when the engagement assembly is in the engaged position so that the garment is retained in the first configuration and the engagement assembly is configured to allow the garment to move to the second configuration when the engagement assembly is in the disengaged position. The engagement assembly may move to the disengaged position upon actuation of the trigger.

In at least some of these embodiments, the first portion is a body of a toy figure and in other embodiments, the garment is a softgoods portion coupled to the first portion and extending therefrom.

In other embodiments of the above toy, the garment includes a first side and a second side, the first side is displayed in the first configuration and the second side is displayed in the second configuration. In some of these embodiments, the first side includes a first pattern or indicia and the second side includes a second pattern or indicia. In other embodiments of this toy, the first portion includes a first subportion and a second subportion and the second portion is configured to cover the first subportion in the first configuration and to cover the second subportion in the second configuration. The first subportion may be a tail in some embodiments and in other embodiments, the second subportion may be a fin. In other embodiments with two subportions, the first subportion and first side include a first pattern or indicia and the second subportion and the second side include a second pattern or indicia.

In still further embodiments of the toy doll above, the toy doll also includes a hinge assembly, the hinge assembly coupling the first portion to the garment and biasing the garment in the second configuration. In other embodiments, the engagement assembly comprises a retractable rod and the retractable rod is disposed within the first portion when in the disengaged position. In at least one of these embodiments, the garment includes at least one engagement portion, each engagement portion being engagable with the retractable rod.

According to another embodiment of the present invention, a toy with a movable portion is a toy doll including a body that includes a front portion and a back portion, a softgoods portion hingedly coupled to the body on the front portion of the body and removably engaged to the body on the back portion, and a trigger included in the front portion of the body. The trigger is configured to cause the softgoods portion to disengage from the back portion of the body and move from a first configuration to a second configuration.

In some embodiments of the toy doll of the present invention, the softgoods portion is hingedly coupled to the front portion of the body by a hinge assembly and the hinge assembly is biased to move the softgoods portion to the second configuration.

In other embodiments, the softgoods portion is releasably coupled to the back portion of the body by a retractable rod and the retractable rod is configured to move within the body when the trigger is actuated. In some of these embodiments the retractable rod is configured to disengage the softgoods portion from the body by moving from an extended position to a retracted position when the trigger is actuated. However, in other embodiments, the retractable rod is configured to disengage the softgoods portion from the body by moving from a retracted position to an extended position when the trigger is actuated.

According to yet another embodiment of the present invention, a toy with a movable portion is a toy doll including a first portion, a garment coupled to the first portion and movable relative to the first portion between a first configuration and a second configuration, an engagement assembly, and a hinge assembly. The engagement assembly is movably coupled to the first portion and movable between an engaged position and a disengaged position. The engagement assembly is configured to retain the garment in the first configuration when the engagement assembly is in the engaged position and the engagement assembly moves to the disengaged position upon actuation of the trigger. The hinge assembly is biased to move the garment to the second configuration when the garment is no longer retained in the first configuration by the engagement assembly.

In some of these embodiments the first portion is a body, the garment is a softgoods portion, and the engagement portion is a retractable rod. In other embodiments, the garment includes at least one engagement portion that is engagable with the engagement assembly.

BRIEF DESCRIPTION OF THE DRAWINGS

Like reference numerals have been used to identify like elements throughout this disclosure.

DETAILED DESCRIPTION OF THE INVENTION

Generally referring to the figures, at least one exemplary embodiment of a toy with a movable portion is shown. The movable portion, which may also be referred to as a second portion or garment, is movable with respect to a first portion of the toy and the second portion, or sections thereof, may be moved relative to the first portion of the toy in order to provide different configurations or appearances. In some embodiments, the second portion may be movably mounted to the first portion by a mounting which allows the second portion to rotate or pivot about or around the first portion.

Figure 1:
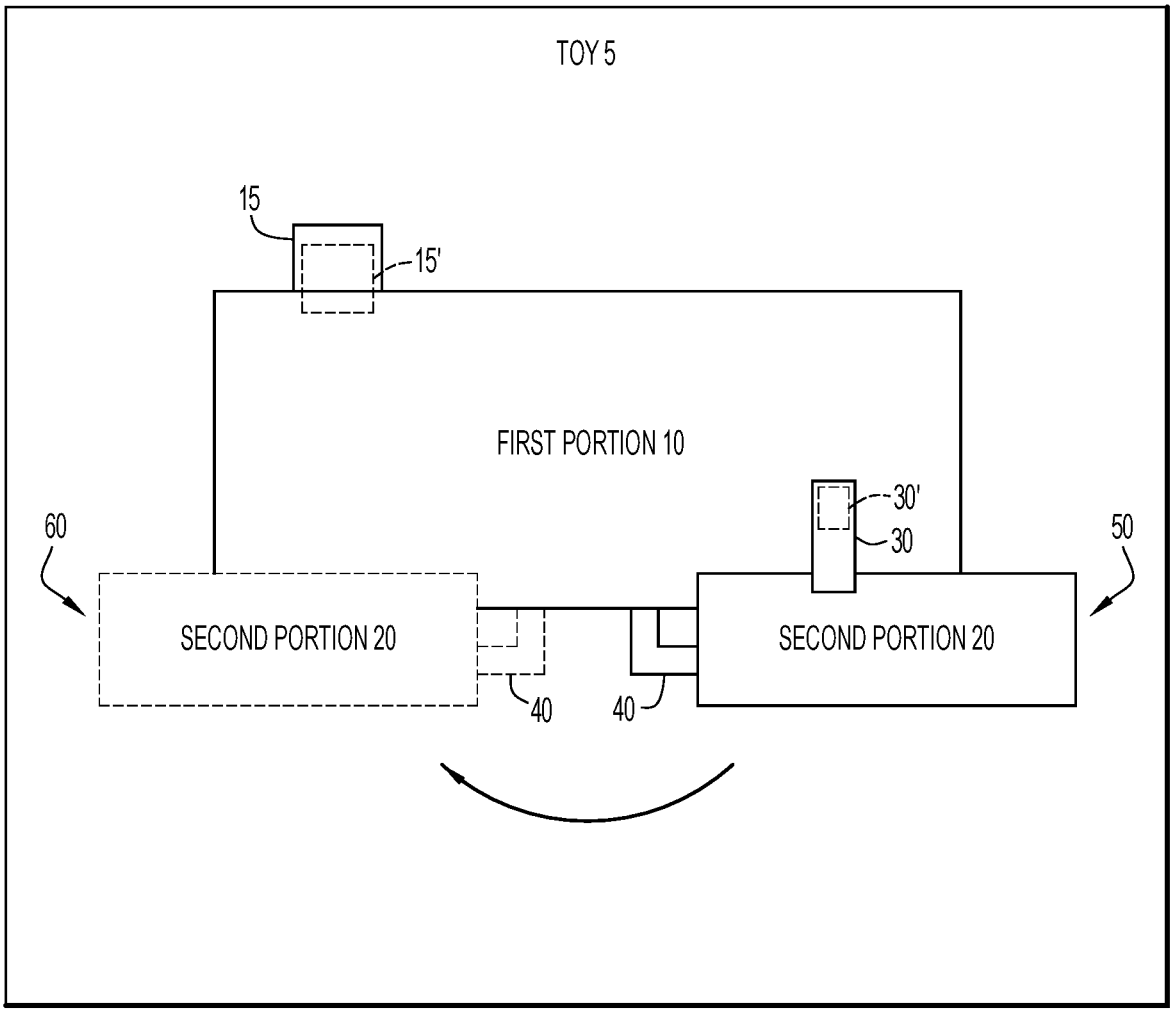
FIG. 1 shows a block diagram of an exemplary embodiment of a toy doll with a movable portion in accordance with the present invention.

For example, as shown in the block diagram of FIG. 1, a toy 5 includes a first portion 10 that is movably connected to a second portion 20 via a hinge assembly 40 that allows the second portion 20 to move between a first configuration 50 and a second configuration 60 (shown in dashed lines). The first portion 10 also includes a trigger 15 and an engagement assembly 30 that may selectively couple the second portion 20 to the first portion 10. As shown in FIG. 1, when the toy 5 is in its first configuration 50, the hinge assembly 40 and the engagement assembly 30 both couple the first portion 10 to the second portion 20. However, when trigger 15 is actuated, such as by being depressed to the location of trigger 15', the engagement assembly 30 moves out of engagement with the second portion 20, as shown by engagement assembly 30', allowing the second portion 20 to move, about hinge assembly 40, to the second configuration 60. Although the engagement assembly 30 is shown retracting into the first portion 30 when trigger 15 is actuated, in other embodiments the engagement assembly 30 may alternatively extend out of first portion 10 and still allow the second portion 20 to move to its second configuration 60. In the first configuration 50, the second portion 20 covers a first part or subportion of first portion 10 and in the second configuration 60, the second portion 20 may cover a second part or subportion of first portion 10. Accordingly, each configuration 50, 60 may give the toy 5 a different appearance.

Still referring to FIG. 1, in some embodiments, the engagement assembly 30 may be mechanically coupled to the trigger 15, such that actuation of trigger 15 to an actuated position, such as the position shown by trigger 15', may cause the engagement assembly 30 to move within the first portion 10, such as to the position shown by engagement assembly 30'. In some of these embodiments, the trigger 15 may be a spring-biased button, such that subsequent to actuation of trigger 15, the trigger 15, as well as the engagement assembly 30 in the embodiments where the mechanical coupling so permits, each return to a non-actuated or disengaged position, respectively. Alternatively or additionally, the engagement assembly 30 may be spring-biased in order to effectuate a return to its original or engaged position.

Similar to the engagement assembly 30, the hinge 40 may also be mechanically coupled to the trigger 15 in some embodiments. However, in contrast with the engagement assembly 30, hinge 40 may, in some embodiments, only be configured to be released upon actuation of trigger 15, instead of being configured to move therewith. Accordingly, and as will be explained in more detail below, in some embodiments, when the trigger 15 is actuated, the hinge 40 may be released from a locked position—a position which holds the second portion 20 in the first configuration 50—and be free to move to the second configuration 60. In these embodiments, the hinge 40 will only provide a single actuation. In other words, the hinge 40 may not automatically reset after the second portion 20 moves to the second configuration 60 and, instead, after a first actuation, a user may be required to manually move the second portion 20 back into its first configuration 50 in order to allow for a second or subsequent actuation. Furthermore, in some embodiments, the hinge assembly 40 may be biased in a position which holds the second portion 20 in the second configuration 60. Thus, moving the engagement assembly 30 to a disengaged position may cause the second portion 20 to be automatically moved to its second configuration 60.

Figure 2:
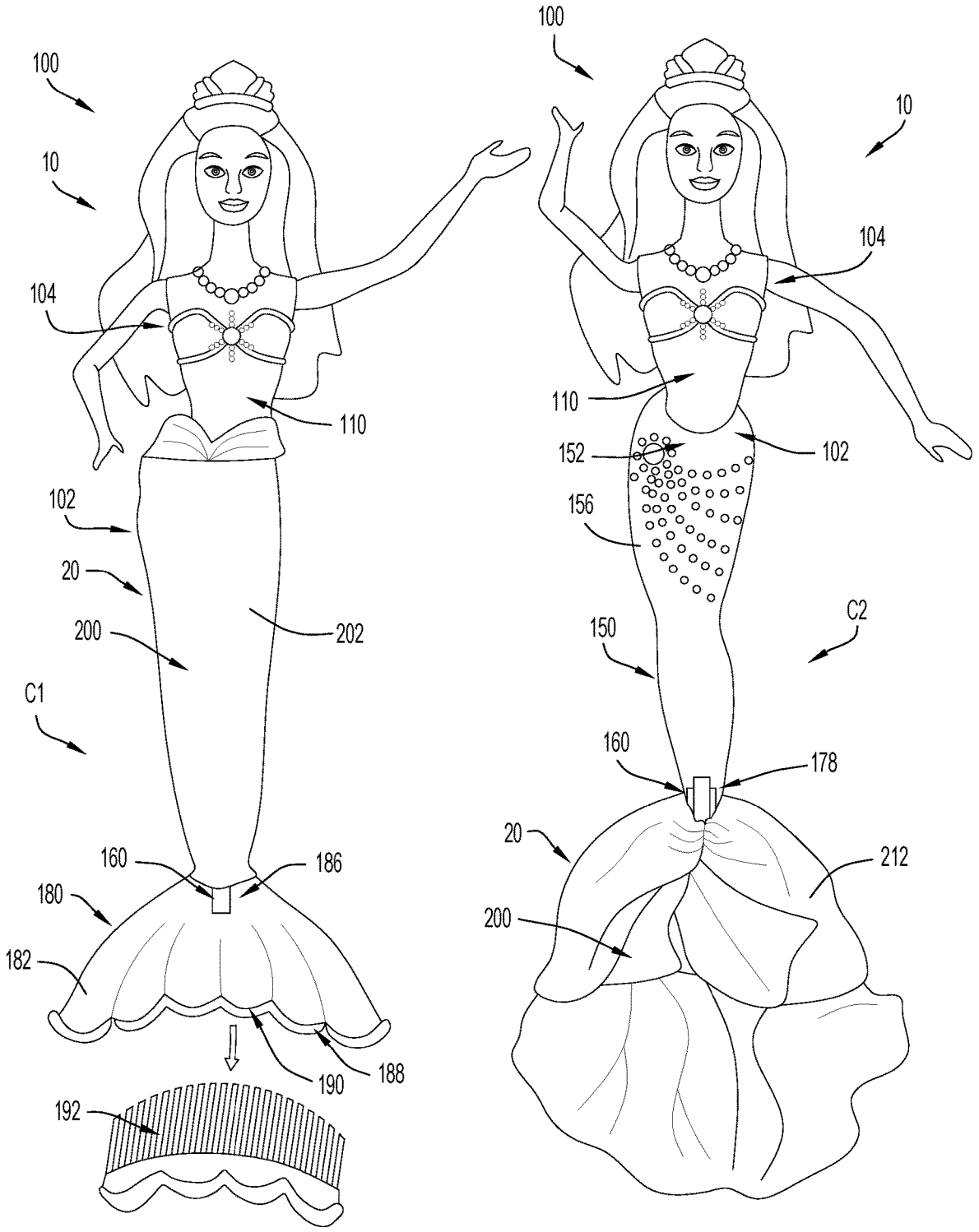
FIG. 2 shows a pair of front perspective views of an exemplary embodiment of a toy doll with a movable portion in accordance with the present invention, the two views showing a movable portion in a first configuration "C1" and a second configuration "C2."

Turning now to FIG. 2, in one exemplary embodiment, the first portion 10 is a body 102 of a human-shaped toy doll and the second portion 20 is a softgoods portion 200. More specifically, FIG. 2 shows a pair of front perspective views of a mermaid-type toy doll 100 with a body 102 and a softgoods portion 200 that may selectively cover different subportions of the mermaid's body 102. However, in other embodiments, first portion 10 and second portion 20 may each be any part or portion of any desirable toy that are movably connected to each other. In this particular embodiment, the body 102 includes a torso 104, a tail 150, and a fin 180, each of which may be referred to as parts or subportions of the body 102, and the softgoods portion 200 is movable between two configurations: a first configuration C1 and a second configuration C2. Specifically, the softgoods portion 200 is movably coupled to body 102 via a hinge assembly 160 and configured to move between a first configuration C1 where the softgoods portion 200 covers at least a portion of the tail 150 and a second configuration C2 where the softgoods portion 200 covers at least a portion of the fin 180.

Figure 3:
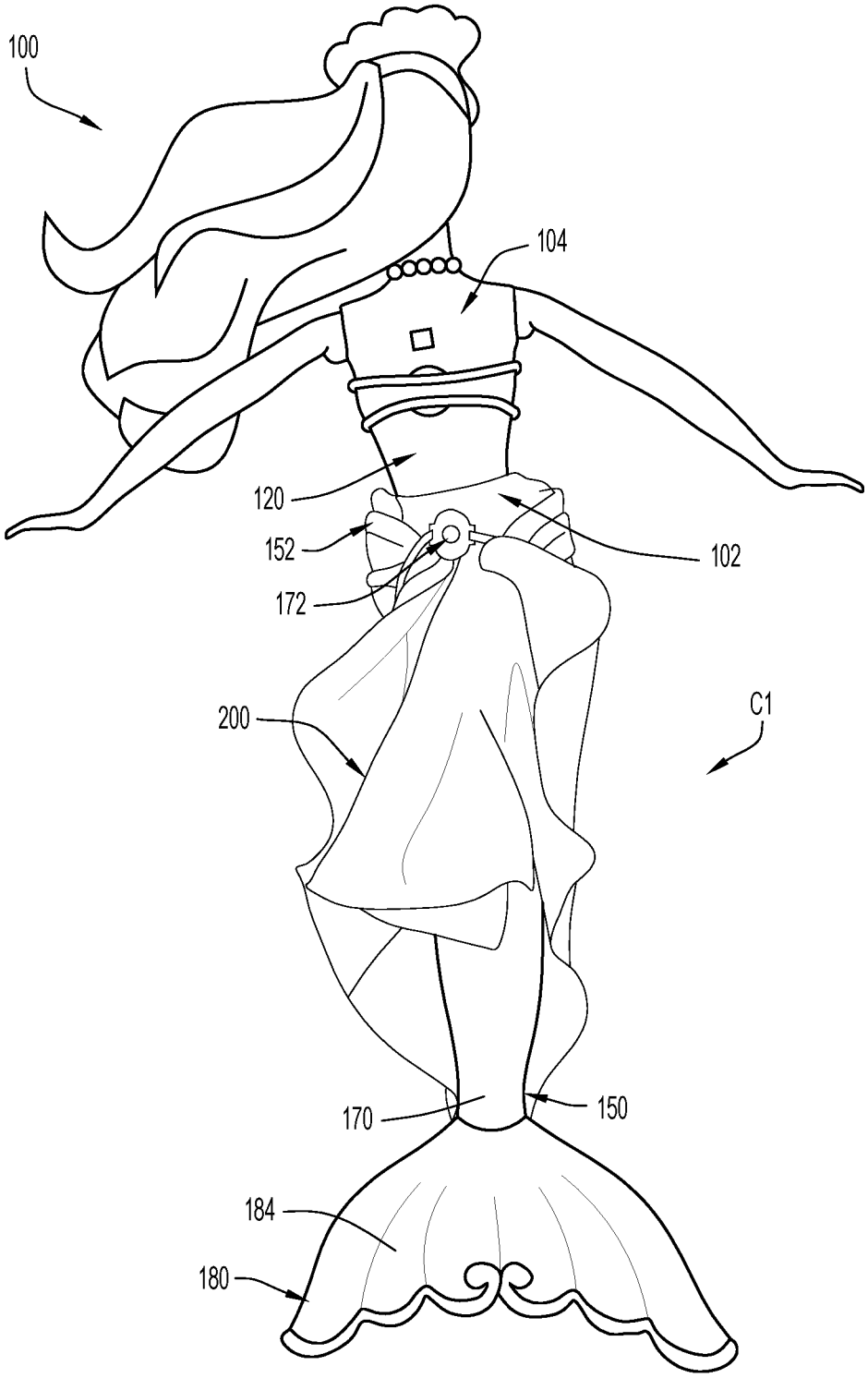
FIG. 3 shows a rear perspective view of another exemplary embodiment of a toy doll with a movable portion in configuration C1.
Figure 4:
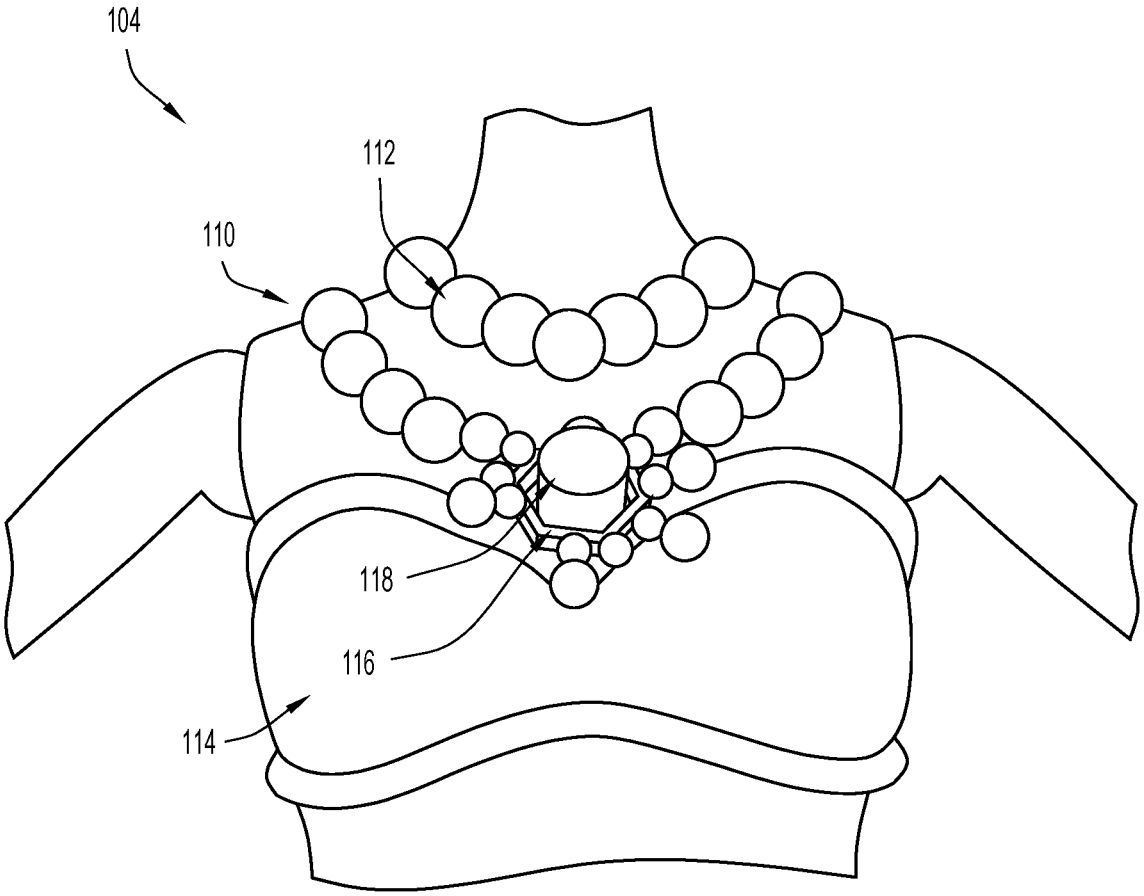
FIG. 4 shows a partial front perspective view of the exemplary embodiment of FIG. 3, the partial view showing a trigger.

Still referring to FIG. 2, but now with reference to FIGS. 3-4 as well, the torso 104 includes a front portion or chest 110 and a rear portion 120 (see FIG. 3) while the tail 150 includes a front portion 156 and a rear portion 170 (see FIG. 3) that extend from a first or top end 152 to a second or bottom end 178. The fin 180 also includes a front side 182, a back side 184 (see FIG. 3), a top 186 and a bottom 188. Collectively, the chest 110, front portion 156, and front side 182 may be referred to as the "front" of the toy doll 100, while the rear portion 120, rear portion 170, and back side 184 may be referred to as the "back" of the toy doll 100.

In the embodiments shown in FIGS. 2-3, each subportion of body 102 is formed from at least two pieces which are coupled together along their sides, and the torso 104 is coupled to the top end 152 of the tail 150 while the fin 180 is coupled to the bottom end 178 of the tail 150. However, in other embodiments body 102 may be formed integrally or from any number of pieces, as desired. Additionally, any combination of subportions of body 102 may be hollow or solid, as desired. For example, and as will be discussed below in further detail, body 102 may include an interior cavity 300 (see FIGS. 10A-C) and the body 102 may include at least one aperture to allow a button 118 (see FIG. 4) and/or an engagement assembly 172 to move within, into, or out of cavity 300. As another example, in some embodiments, the fin 180 may also include an aperture 190 in the bottom 188 of the fin 180 to store accessories or other desirable items for use with the toy doll 100. In the exemplary embodiment shown in FIG. 2, the fin 180 includes an aperture 190 sized to receive a comb 192. The comb 192 may be retained within the aperture 190 by sizing the aperture 190 to create an interference or friction fit which serves to fasten the comb 192 within aperture 190 when the comb 192 is inserted therein.

Turning now to FIG. 3, a rear perspective view of another exemplary embodiment of a toy doll with a movable portion is shown. As can be seen from this rear perspective, the toy doll 100 includes an engagement assembly 172 on its back which can engage at least a portion of the softgoods portion 200 in order to maintain the softgoods portion 200 in the first configuration C1. In this particular embodiment, the engagement assembly 172 is included on the rear portion 170 of tail 150, proximate to top end 152, but in other embodiments, the engagement assembly 172 may be included on any desirable portion of body 102, such as the rear portion 120 of torso 104.

Now referring to FIG. 4, the chest 110 of a toy doll 100 is shown from a front perspective. As can be seen in this figure, chest 110 includes an aperture 116 and a trigger or button 118 mounted therein. In this embodiment, the aperture 116 and button 118 are incorporated into clothing and decorations included on the chest. Specifically, the chest 110 includes an article of clothing which resembles a bathing suit top 114 and various jewels, accessories and decorations, including necklace 112, and the aperture 116 and button 118 are disposed therebetween such that these features blend in with the doll and appear to be a jewel included in at least one of the bathing suit top 114 and necklace 112. In various embodiments, the chest 110 of the doll 100 may be decorated with any desirable clothing or accessories, and the clothing and accessories, such as bathing suit top 114 and necklace 112 may either be formed integrally with chest 110 or formed separately and subsequently coupled thereto.

Figure 5A:
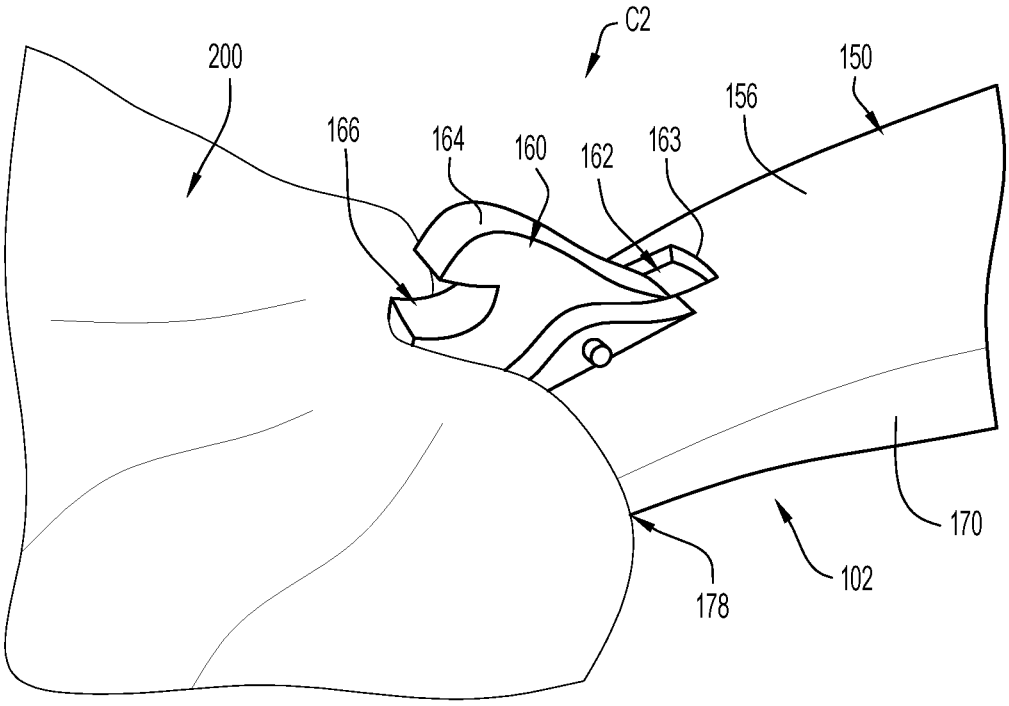
FIGS. 5A and 5B show partial side views of two exemplary embodiments of FIGS. 2 and 3, respectively, the partial view showing two exemplary hinge assemblies.
Figure 5B:
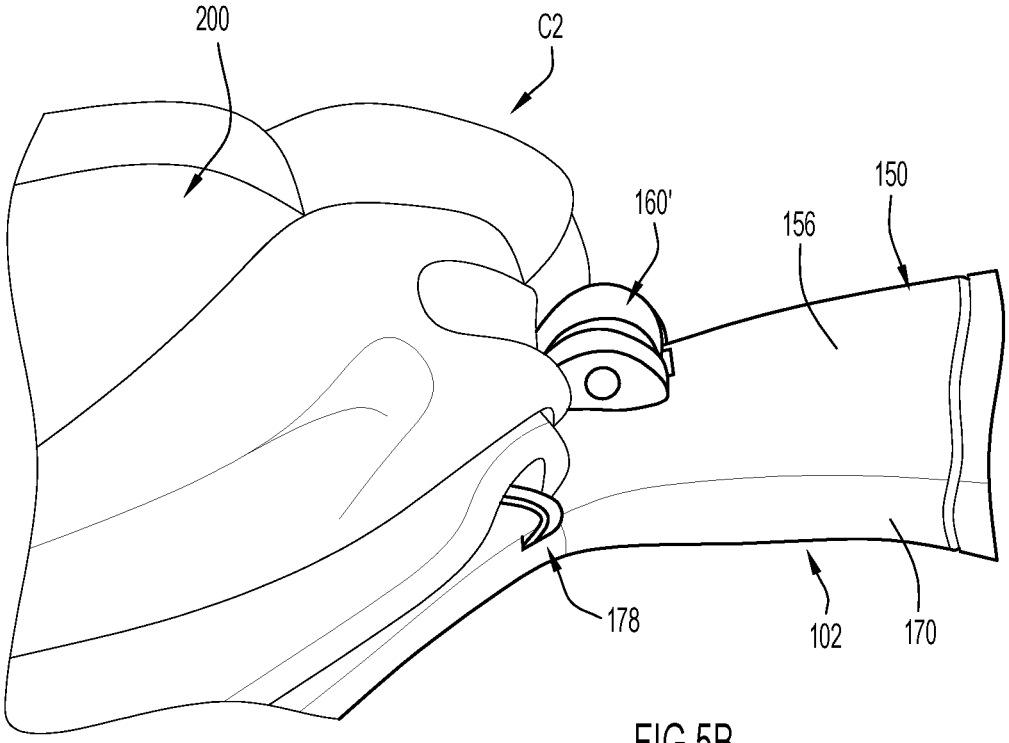

Referring next to FIGS. 5A-5B, partial views of two embodiments of doll 100 are shown in the second configuration C2 in order to highlight the interplay between body 102, softgoods portion 200, and two hinge assemblies utilized in two different embodiments—hinge assembly 160 and hinge assembly 160'. As can be seen in FIG. 5A, in some exemplary embodiments, the hinge assembly 160 includes a rotatable member 164 that is coupled to the softgoods portion 200 and rotatably mounted within an opening 162 formed in the front portion 156 of tail 150. However, in other embodiments, such as the embodiment shown in FIG. 5B, a hinge assembly 160' which is a simple hinge which protrudes from the front portion 156 of the tail 150 may be utilized. Regardless, hinge assemblies 160 and 160' both couple the softgoods portion 200 to body 102. In fact, in some embodiments, the hinge assembly 160, 160' may also serve to couple the fin 180 and the tail 150 together.

More specifically, in the embodiments shown in FIGS. 5A-B, hinge assembly 160, 160' couples the softgoods portion 200 to the body 102 proximate a joint between the bottom end 178 of the tail 150 and the top 186 (see FIG. 2) of fin 180. In both embodiments, the hinge assembly 160, 160' is configured such that it may rotate approximately 180 degrees from the second configuration C2, as seen in FIGS. 5A-B, to the first configuration C1 (see the left side of FIG. 2). In some embodiments, the hinge assembly 160, 160' may be biased by any desirable biasing member (not shown) in the position seen in FIGS. 5A-B, thereby biasing the softgoods portion 200 towards the second configuration C2.

Now referring specifically to FIG. 5A, in this embodiment, the rotatable member 164 is mounted within opening 162. The rotatable member 164 also includes a cavity or indent 166 and the opening 162 also includes a peripheral edge 163. In some embodiments, the indent 166 may be sized to receive the peripheral edge 163 of the opening 162, such that the rotatable member 164 may be locked substantially within the opening 162 when positioned therein by lodging the peripheral edge 163 within the indent 166. In order to enable such a position, in some embodiments, the rotatable member 164 may be laterally movable within the opening 162. Alternatively, at least a portion of the rotatable member 164 may be flexible to allow the rotatable member 164 to be locked within opening 162. In other embodiments, the indent 166 engages with a structural piece inside the tail 150. The structural piece may be a locking pin that engages with the indent 166 within the tail 150 to hold the softgoods portion 200 in a first configuration C1. However, in preferred embodiments, the rotatable member is not laterally movable within opening 162 and, instead, is simply biased towards the position seen in FIG. 5A, such that softgoods portion 200 must be coupled to the body 102 in a second location in order to secure the softgoods portion 200 in the first configuration C1. Some embodiments may also include an internal locking pin in order to secure the rotatable member 164 in desired positions.

Figure 6A:
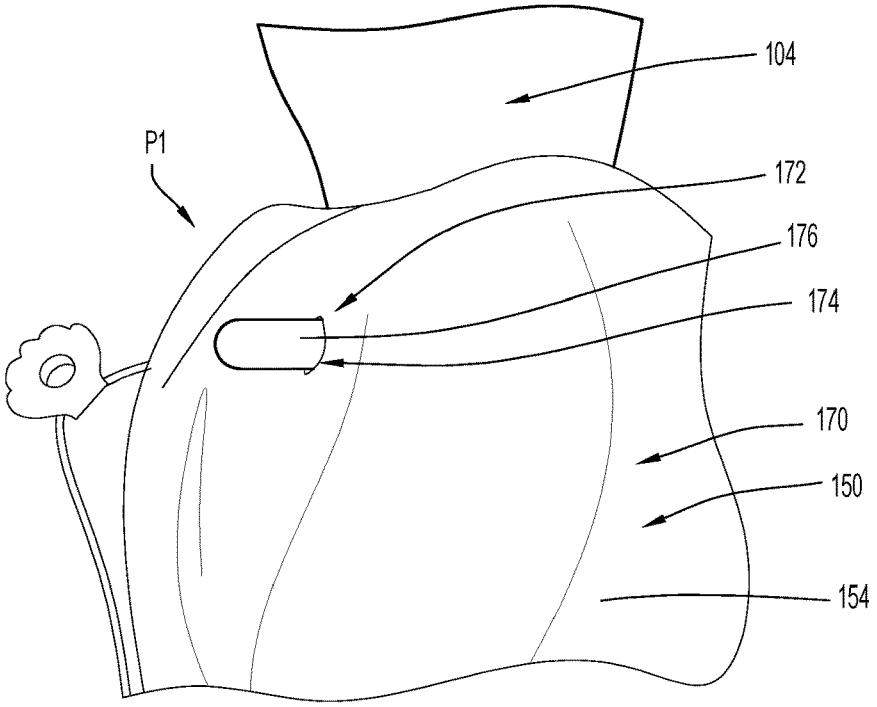
FIGS. 6A and 6B show partial rear perspective views of the exemplary embodiment of FIG. 3, the partial views showing at least part of an engagement assembly, the engagement assembly being in an engaged position "P1" in FIG. 6A and a disengaged position "P2" in FIG. 6B.
Figure 6B:
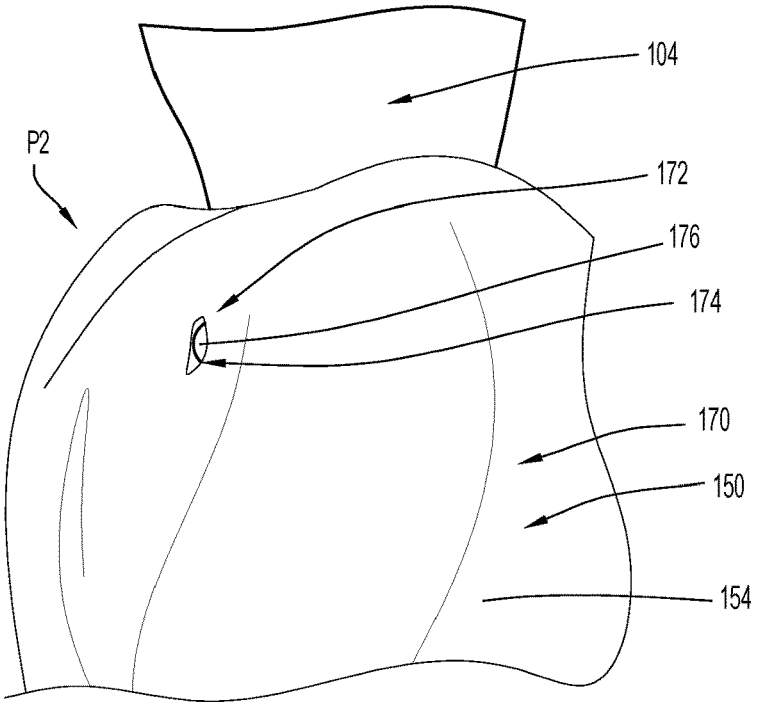
Figure 6C:
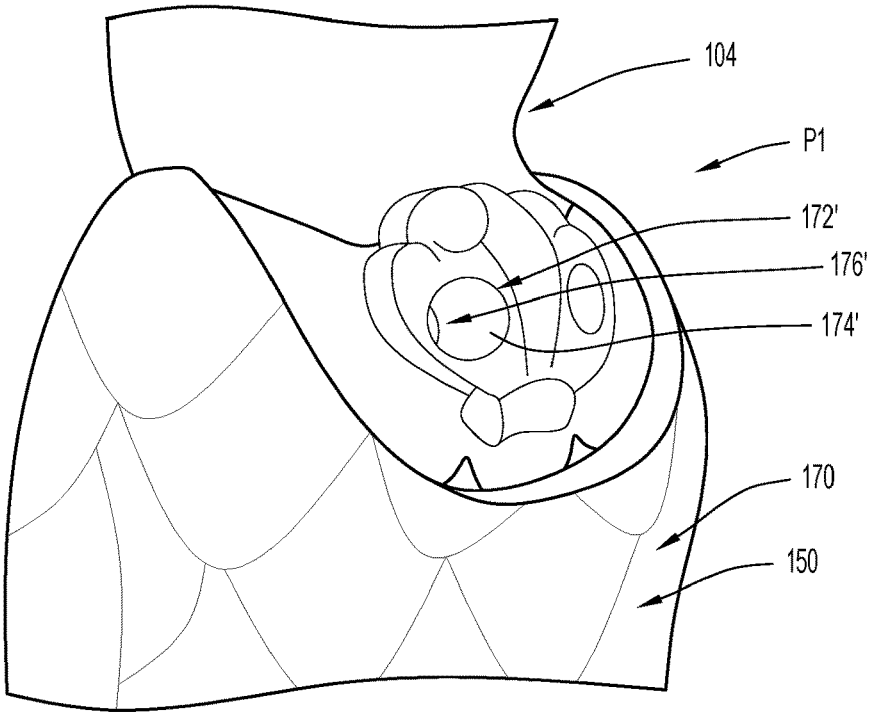
FIGS. 6C and 6D show partial rear perspective views of another exemplary of a toy doll with an movable portion in accordance with the present invention, the partial views showing at least part of an engagement assembly, the engagement assembly being in a engaged position "P1" in FIG. 6C and an disengaged position "P2" in FIG. 6D.
Figure 6D:
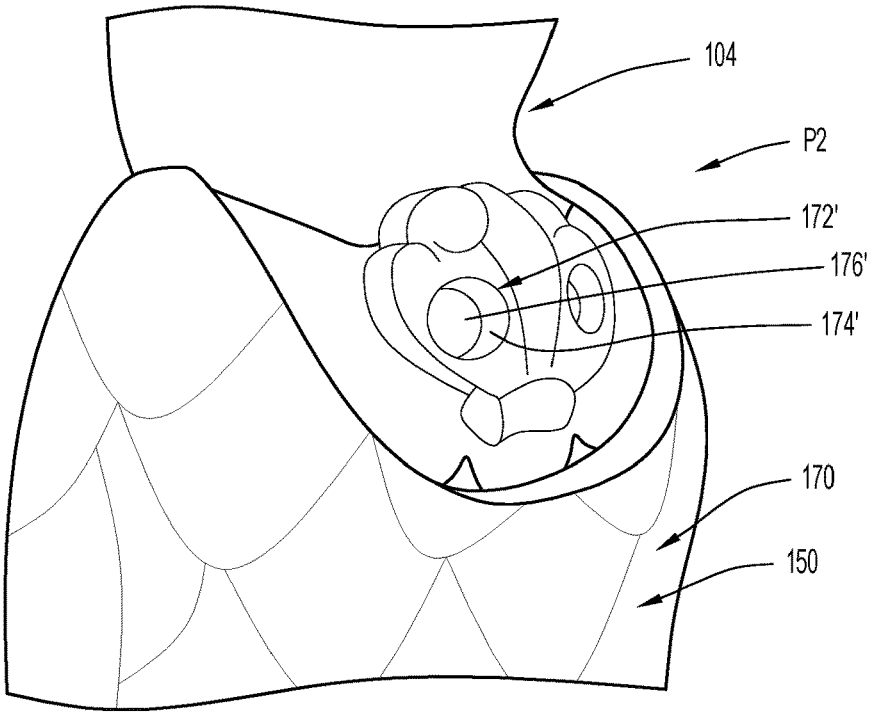

Now referring to FIGS. 6A-D, two embodiments of an engagement assembly—engagement assemblies 172 and 172'—are shown in an engaged position P1 (FIGS. 6A and 6C) and a disengaged position P2 (FIGS. 6B and 6D). Each engagement assembly 172, 172' includes at least one aperture 174, 174' and at least one extendable member or rod 176, 176' which can extend and retract from or within the at least one aperture 174, 174'. Rods 176, 176' may be alternatively referred to as retractable rods. In some embodiments, each of the extendable rods 176, 176' may simply slide within its respective aperture 174, 174', but in other embodiments, each extendable rod 176, 176' may move within aperture 174, 174' in any desirable manner. For example, some embodiments may include a retraction mechanism disposed within the body 102 that can move each extendable rod 176, 176' between its engaged and disengaged positions P1, P2, respectively, while in other embodiments the extendable rod 176, 176' may be extensible and, thus, could collapse into or onto body 102.

In the embodiments shown in FIGS. 6A-D, the engagement assemblies 172, 172' are included on the rear portion 170 of the tail 150 and, thus, when the extendable rod 176, 176' moves into or within body 102, it slides into or within the interior cavity 300 (see FIGS. 10A-10C) adjacent the top end 152 of tail 150. In other embodiments, the engagement assembly 172, 172' may be located in any desirable location on body 102, thereby allowing extendable rod 176, 176' to be disposed within another portion of interior cavity 300 as desired.

In different embodiments, the extendable rod may move in different manners when moving between the engaged position P1 and the disengaged position P2. For example, the embodiment shown in FIGS. 6A-B includes an extendable rod 176 which extends out of the aperture 174 a desirable amount when disposed in the engaged position P1, as shown in FIG. 6A. Then, when the extendable rod 176 is moved to a disengaged position P2, perhaps via actuation of button 118, the extendable rod 176 may move substantially within the body 102, as shown in FIG. 6B. By comparison, the embodiment shown in FIGS. 6C-D includes two apertures 174' and two extendable rods 176' and the extendable rods 176' are disposed within the interior cavity 300 of body 102 when in the engaged position P1. Then, when the extendable rods 176' are moved to a disengaged position P2, the extendable rods 176' may move outwards in apertures 174', as shown in FIG. 6D. In some of these embodiments, the extendable rods 176' may extend out of the apertures 174', but in other embodiments, the extendable rods 176' move outwards within the apertures 174' without protruding from apertures 174' (as seen in FIG. 6D). In other words, in the embodiment shown in FIGS. 6A-B the retractable rod 176 may move from an extended position to a retracted position when moving from position P1 to position P2 while in the embodiment shown in FIGS. 6C-D the retractable rods 176' may move from a retracted position to an extended position when moving from position P1 to position P2.

Referring again to FIGS. 6A-B, in some embodiments (and best seen in FIG. 9), the toy doll may include a skirt 154 which extends around at least a portion of the body 102. In the particular embodiment shown in FIGS. 6A-6B, the skirt 154 extends over the rear portion 170 of the tail 150. In such an embodiment, the skirt 154 may also include a hole or aperture (not labeled) to allow the extendable rod 176 to extend therethrough. In order to ensure that the extendable rod 176 is aligned with a hole or aperture included on a skirt 154, the portion of the skirt 154 surrounding any hole included therein may be secured to the body 102 to align the skirt hole with aperture 174. However, in other embodiments any desirable method or arrangement may be utilized to allow the extendable rod 176 to move between its engaged position P1 and its disengaged position P2.

Figure 7B:
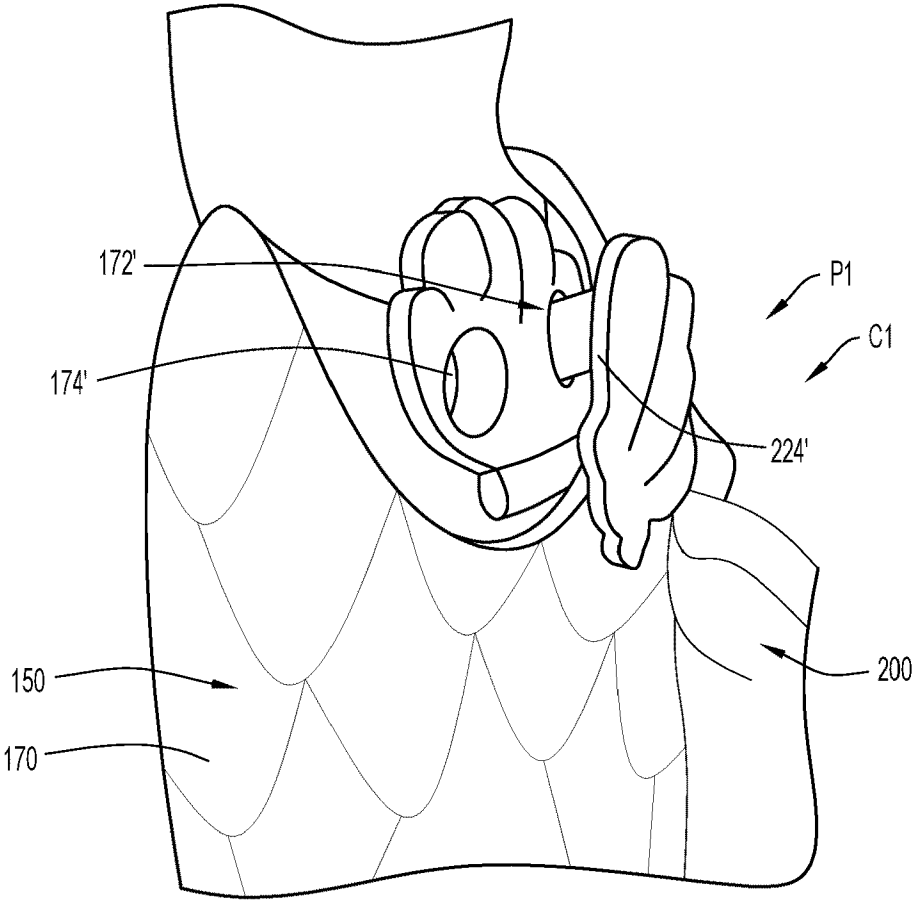
FIGS. 7A and 7B show rear perspective views of the engagement assemblies of FIGS. 6A-B and 6C-D, respectively, in partial engagement with the movable portion of the toy doll.
Figure 7A:
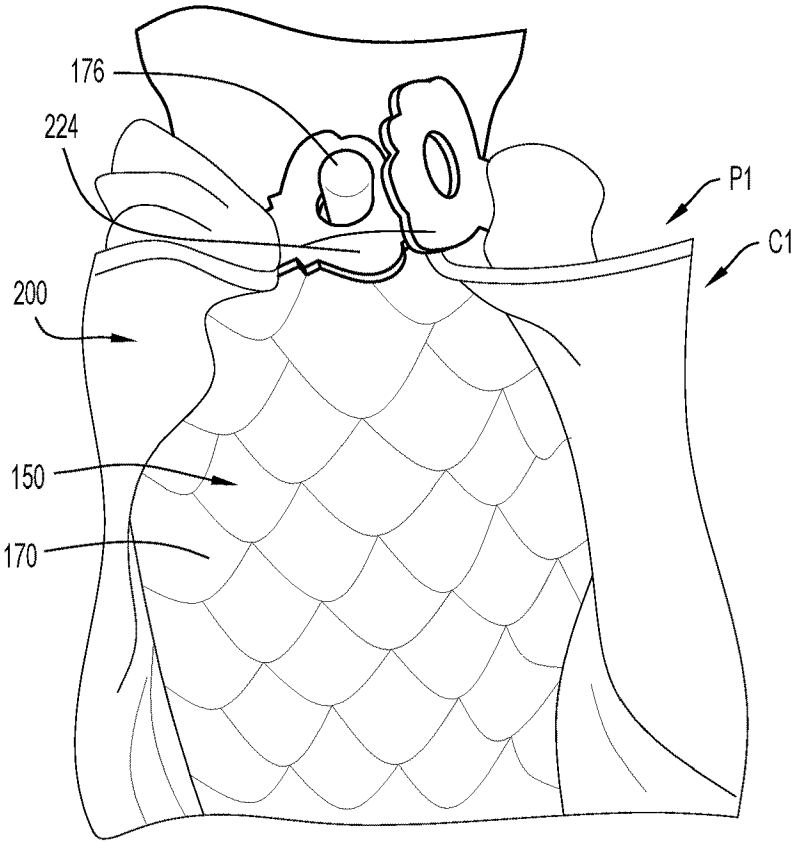
Figure 8B:
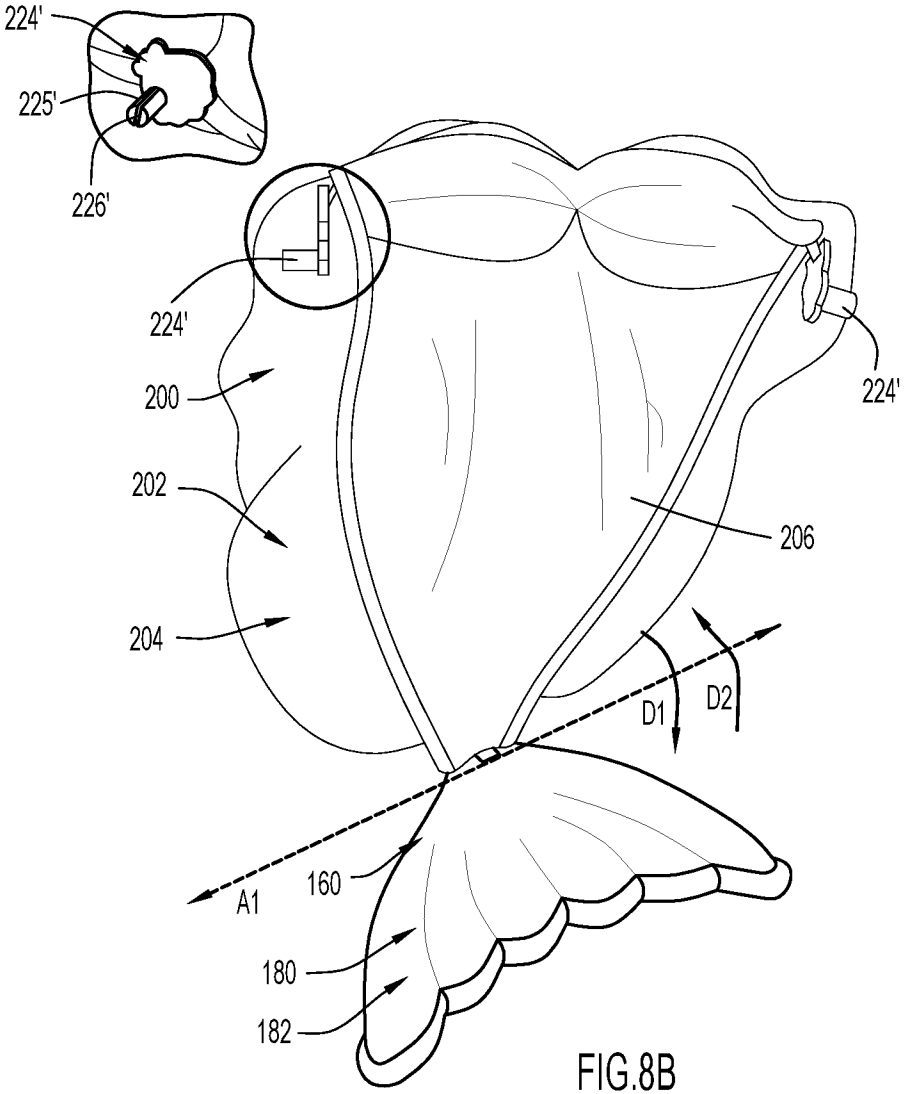
FIGS. 8A and 8B show perspective views of two exemplary embodiments of a movable portion in accordance with the present invention, each being disposed in an intermediate configuration between configurations C1 and C2. The movable portion of FIG. 8A being engagable with the engagement assembly of FIGS. 6A-B and the movable portion of FIG. 8B being engagable with the engagement assembly of FIGS. 6C-D.
Figure 8A:
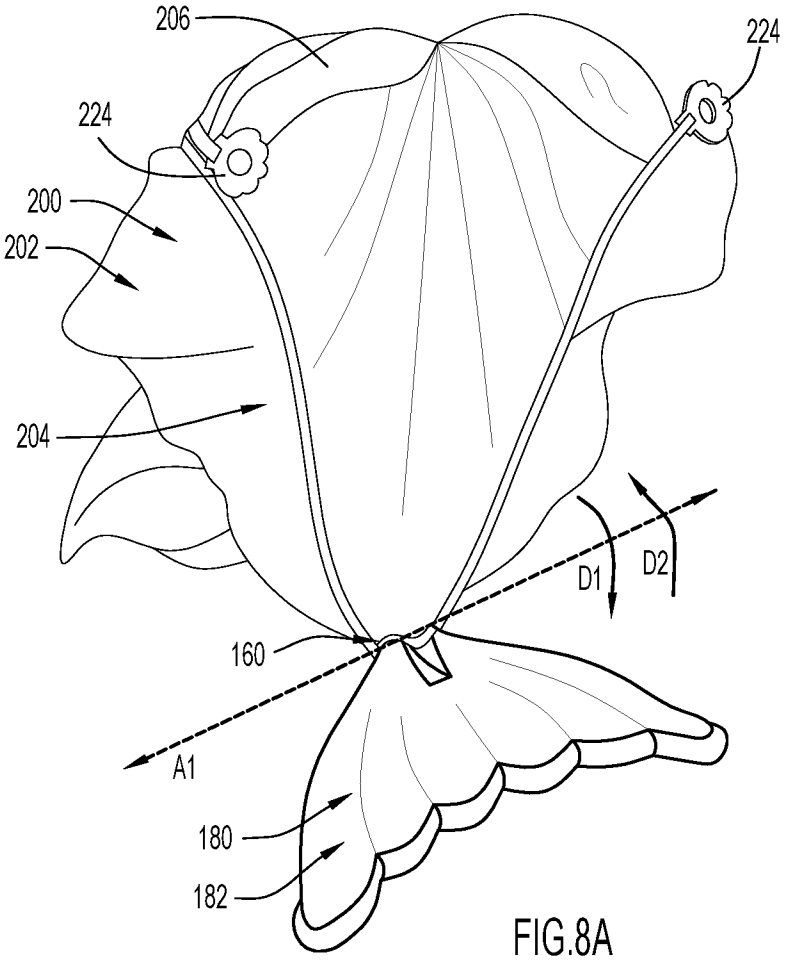

Turning now to FIGS. 7A, 7B, 8A, and 8B, two embodiments of the softgoods portion 200 are shown, each including at least one engagement portion—engagement portion 224 and 224'. However, although the embodiment shown in FIG. 7B only shows one engagement portion 224', it is to be understood that each embodiment includes two engagement portions 224, 224' (as shown in FIGS. 8A and 8B) which can be secured to the engagement assemblies 172, 172', respectively. In other embodiments, any desirable number of engagement portions may be included on the softgoods portion 200.

Referring first to FIG. 7A, in this embodiment, the softgoods portion 200 includes two engagement portions 224 which may be looped or secured onto the extendable rod 176 of the engagement assembly 172 in order to maintain or retain the softgoods portion 200 in the first configuration C1. In this embodiment, the engagement portions 224 are only secured to the extendable rod 176 because the extendable rod 176 is extending through the engagement portions 224, the engagement portions 224 are not locked or otherwise secured to the extendable rod 176 in any additional manner. Thus, if the extendable rod 176 is retracted, as explained above with reference to FIGS. 6A-B, then the engagement portions 224 may be released or fall off of the extendable rod 176, thereby freeing the softgoods portion 200 to move to its second configuration C2. However, in other embodiments, the engagement portions 224 may be secured to and released from the rods 176 as desired.

Now referring to FIG. 7B, in this embodiment the softgoods portion 200 includes two engagement portions 224' which may be inserted into the apertures 174' of the engagement assembly 172' in order to maintain or retain the softgoods portion 200 in the first configuration C1. Since the extendable rods 176' of the engagement assembly 172' are disposed within cavity 300 when the engagement assembly 172' is disposed in its engaged position, the engagement portions 224' may sit securely within apertures 174' as long as the engagement assembly 172' remains in its engaged position P1. As shown in the inset of FIG. 8B, the engagement portion 224' includes a protrusion 225' with a slit 226' to ensure that each engagement portion 224' can fit securely within an aperture 174'. Then, when the extendable rods 176' are moved to the disengaged position P2, they will extend into or through apertures 174', thereby contacting the engagement portions 224' and pushing or knocking them out of the apertures 174'. Thus, when the extendable rods 176' are in their disengaged position P2, the engagement portions 224' may be decoupled, disengaged, or otherwise released from the engagement assembly 172', thereby freeing the softgoods portion 200 to move to its second configuration C2.

Figure 9:
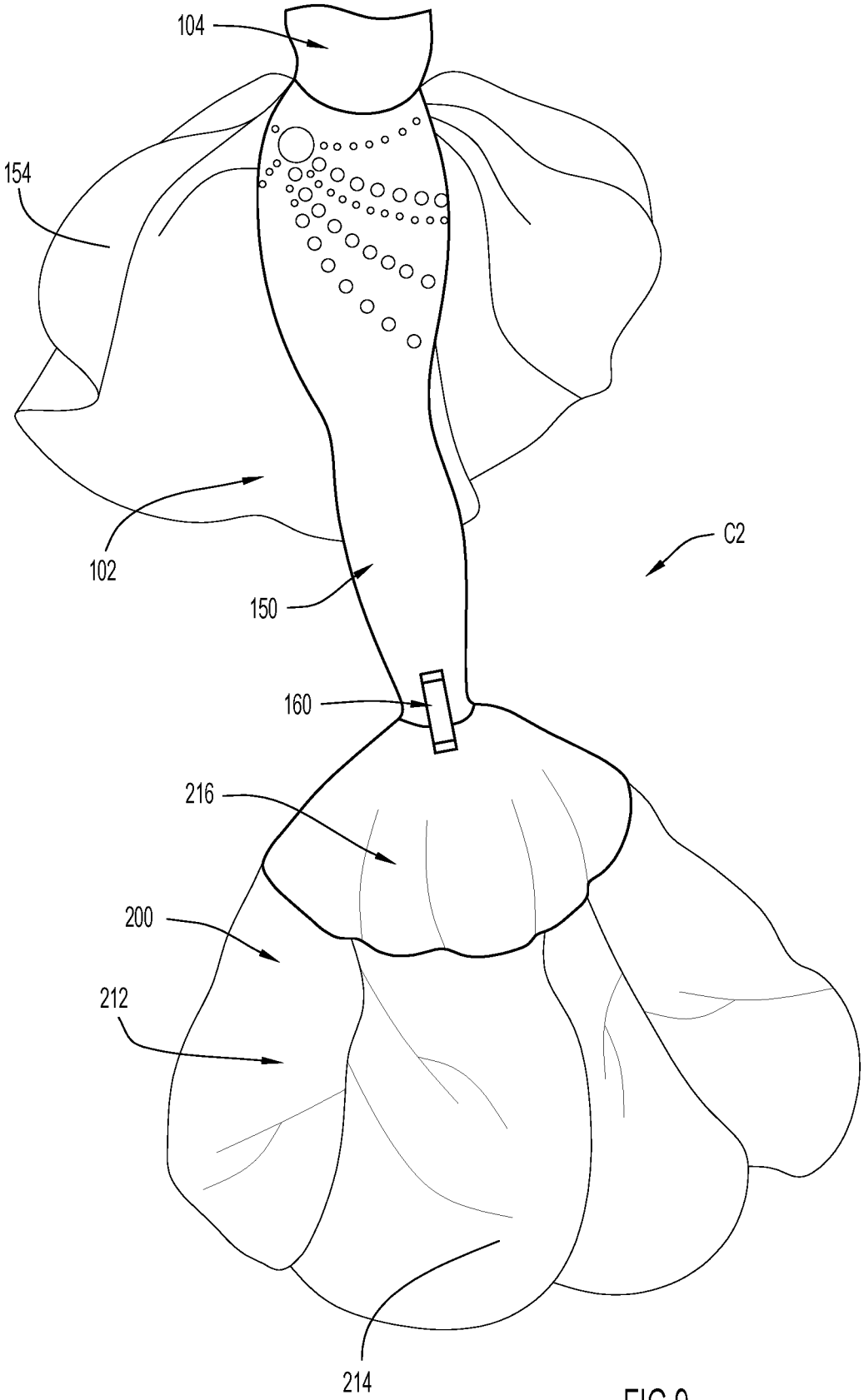
FIG. 9 shows a partial perspective view of the exemplary embodiment of FIG. 3 in configuration C2.

Referring next to FIGS. 8A, 8B, and 9, the softgoods portion 200 includes a first side 202 and a second side 212 which are configured such that the first side 202 is shown or displayed in configuration C1 and the second side is shown or displayed in configuration C2 (see FIG. 2). Each side 202, 212 includes at least one material, coating, indicia, or coloring that is different from the other side 202, 212, such that the different sides 202, 212 each have a distinct pattern or visual appearance. Thus, the toy doll 100 will have a different appearance and/or color scheme depending on which side 202, 212 is shown or displayed. For example, in the present embodiment, the first side 202 is blue and the second side 212 is substantially pink. In other embodiments, each side may include be any desirable color, design indicia, or color scheme, and these colors and designs may collectively be referred to as a pattern.

As seen best in FIG. 2, when the toy doll 100 is in configuration C1, the fin 180 and first side 202 of the softgoods 200 are displayed together, but when the toy doll 100 is in configuration C2, the tail 150 and the second side 212 of the softgoods 200 are displayed together. Thus, in order to provide a more realistic appearance of transformation, the fin 180 may include a coloring or pattern which matches that of first side 202 and the tail 150 may include a coloring or pattern which matches that of second side 212. In such embodiments, moving the doll 100 from the first configuration C1 to the second configuration C2 may cause the doll 100 to appear to be transforming or changing from a blue-themed mermaid to a pink-themed mermaid. However, in other embodiments, any desirable parts or portions of the body 100 may be colored to match the sides 202, 212 of the softgoods 200 in order to increase the play value of the doll or give a transforming appearance.

Still referring to FIGS. 8A, 8B, and 9, in some embodiments, each side 202, 212 of the softgoods portion 200 may include one or more sections, which may be defined by different materials, coloring, coatings, indicia or other desirable features in order to give the doll 100 two different appearances when the different sides 202, 212 of the softgoods 200 are showing. For example, in the present embodiment, the first side 202 includes a first segment 204 and a second segment 206 while the second side 212 includes a first segment 214 and a second segment 216. However, the two segments 204, 206 of the first side 202 are separated laterally while the two segments 214, 216 of the second side 212 are separated longitudinally.

More specifically, and as shown in FIGS. 8A and 8B, the first segment 204 is a first, gossamer or softer material and the second segment 206 is a sturdier material which resembles scales. Additionally, the first segment 204 is shaped to follow the contours of the tail 150. By comparison, and as seen in FIG. 9, the first segment 214 and second segment 216 of the second side 212 are each formed from similar material, but the second segment 216 includes a sparkly finish or coating and is shaped to follow the contours of fin 180. Consequently, in this particular embodiment, the shapes of the second segments 206, 216 provide a doll 100 with the features of a mermaid (i.e. a tail and a fin) even when these features are covered by the softgoods portion 200. However, in other embodiments, any number of segments, shaped and sized as desired, may be incorporated into the softgoods portion 200 in order to create a visually stimulating play feature.

Referring generally to FIGS. 1-10C, in use, the softgoods portion 200 can move from its first configuration C1 to its second configuration C2 by rotating about a hinge assembly, such as hinge assemblies 160, 160'. In the embodiments shown in FIGS. 2-10C, the doll 100 is initially provided with the softgoods portion 200 in its first configuration C1 and the extendable rod 176, 176' of the engagement assembly 172, 172' in its engaged position P1. Additionally, in order to ensure that the softgoods portion 200 is retained in the first configuration C1, the engagement portions 224, 224' are initially secured around the extendable rod 176, 176' or within apertures 174, 174', respectively. Then, when desired, a user may actuate the button 118, such as by pressing the button 118 inwards, and into aperture 116, in direction "D3" (see FIGS. 10A-C). This, in turn, may cause the extendable rod 176, 176' to move to its disengaged position P2 (either by moving within the body or by pushing the engagement portions 224' out of the apertures 174'), thereby disengaging the engagement portions 224, 224' from the engagement assembly 172, 172' and freeing the softgoods portion 200 to move to its second configuration C2. Then, as illustrated in FIGS. 8A and 8B, the softgoods portion 200 may be rotated to the second configuration C2 about an axis "Al" in a direction "D2" by the hinge assembly 160, 160', which may be biased to hold the softgoods in the second configuration C2. In order to effectuate this movement, the toy 100 includes various internal components and mechanisms.

Figure 10A:
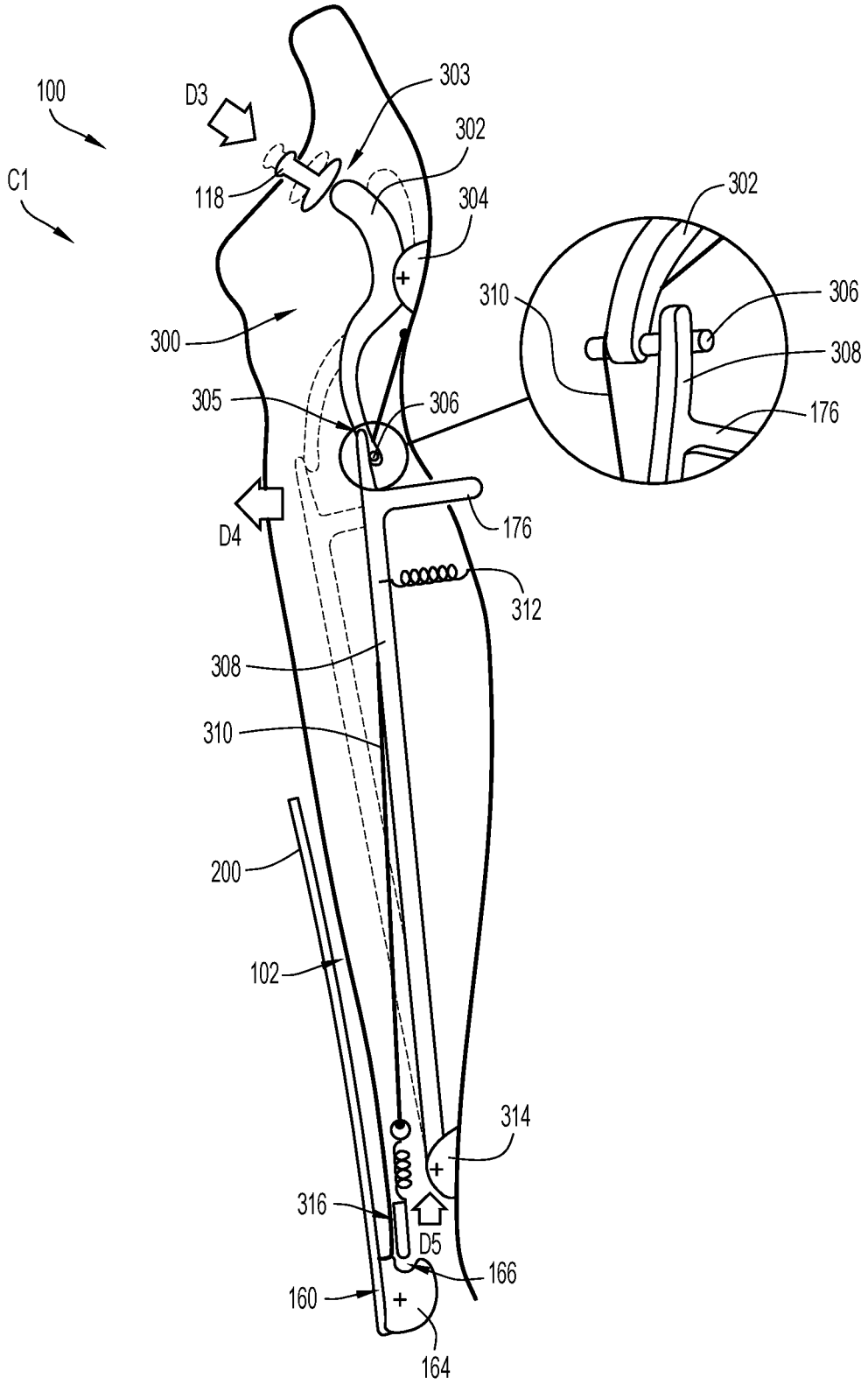
FIG. 10A shows an internal view of an exemplary embodiment of a toy doll with a movable portion in accordance with the present invention.

In one embodiment, the toy 100 includes a pivot member 302, a lever arm 308, and a cord 310 mounted internally within a cavity 300 included within the body 102, as shown in FIG. 10A. The pivot member 302 is centrally mounted on a pivot mount 304 while the lever arm 308 has one end mounted to a pivot mount 314 and another end that is free to move, referred to herein as the free end. The free end of lever arm 308 includes the extendable rod 176, is coupled to the back of the body 102 by a biasing member 312 and rests upon a pin 306 that is coupled to a lower end 305 of the pivot member 302. Additionally, as shown in the inset included in FIG. 10A, the cord 310 is also coupled to the back of the body 102, is fed over the pin 306, and is coupled to a locking pin 316 at its lowermost end. The locking pin 316 is configured to sit within the hinge assembly 160, or more particularly within the indent 166 and thus, prevent the rotatable member 164 from rotating.

Due to this internal configuration, when the button 118 is pressed in accordance with arrow D3, it pushes an upper end 303 of a pivot member 302 in direction D3, thereby causing a lower end 305 of the pivot member 302 to pivot about mount 304 and move in a direction "D4." Movement of the lower end 305 in direction D4 causes the free end of lever arm 308 to be moved, by pin 306, in direction D4, thereby retracting the extendable rod 176 into the interior cavity 300. Movement of pin 306 in direction D4 also causes the portion of the cord 310 fed over the pin 306 to move in direction D4, thereby lengthening the overall distance the cord 310 must cover in order to pass from its mounting point to the bottom of body 102. This increase in distance causes the cord 310 to pull locking pin 316 in direction D5. In this embodiment, the cord 310 is configured such that the increased distance covered by cord 310 when pin 306 moves in direction D4 is at least equivalent to the depth of the indent 166 included in the rotatable member 164. Thus, when the button 118 is actuated, the locking pin 316 is lifted out of the indent 166, rendering the rotatable member 164 free to move. Moreover, in this particular embodiment, the rotatable member 164 is biased by a biasing member (not shown, such as a torsion spring) to a position that is disposed approximately 180 degrees from the position seen in FIG. 10A (see for example FIG. 5A).

Figure 10C:
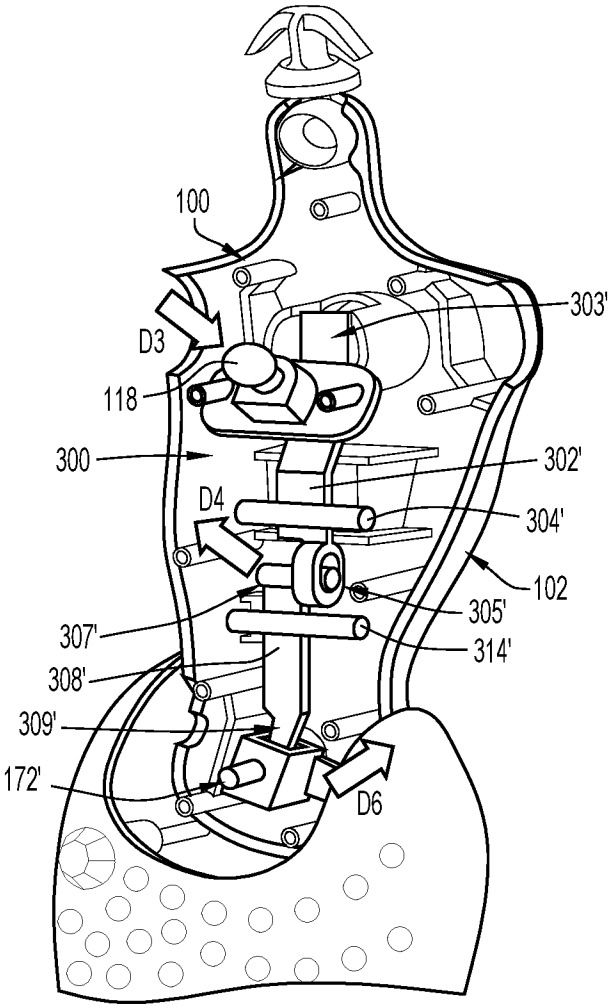
FIGS. 10B-C show internal views of another exemplary embodiment of a toy doll with a movable portion in accordance with the present invention.
Figure 10B:
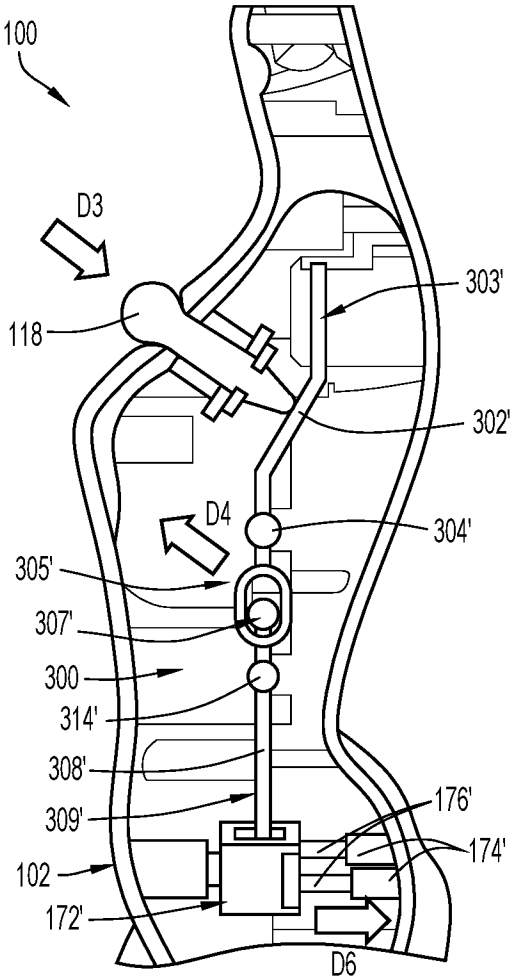

However, and as shown in FIGS. 10B-C, in other embodiments, the trigger 118 may only actuate the engagement assembly 172', as opposed to both the hinge assembly 160' and engagement assembly 172'. In the embodiment shown in FIGS. 10B-C, toy 100 includes a pivot member 302' and a lever arm 308' mounted internally within the internal cavity 300 of body 102. The toy shown in FIGS. 10B-C also includes a simple hinge assembly 160' (not shown in FIGS. 10B-C) which is unrestricted and biased to hold the softgoods portion 200 in configuration C2. In this embodiment, both the pivot member 302' and the lever arm 308' are centrally mounted on pivot mounts 304' and 314', respectively. Thus, the pivot member 302' has an upper portion 303' disposed above mount 304' and a lower portion 305' disposed below mount 304' while the lever arm 308' has an upper portion 307' disposed above mount 314' and a lower portion 309' disposed below mount 314'. The lower portion 309' of lever arm 308' is configured to interact with the engagement assembly 172'.

Due to this configuration, when the button 118 is pressed in accordance with arrow D3, it pushes the upper portion 303' of pivot member 302' in direction D3, causing the lower portion 305' of the pivot member 302' to pivot about mount 304' and move in direction D4, pushing the upper portion 307 of the lever arm 308' in direction D4 as well. However, since the lever arm 308' is centrally mounted, movement of the lower end 305' of the pivot member 302' in direction D4 causes the lever arm 308' to rotate, at least partially, around mount 314', thereby causing the lower portion 309' to push the engagement assembly 172' externally from cavity 300 (instead of internally like lever arm 308). Accordingly, when the trigger 118 is pushed in such an embodiment, the extendable rods 176' will be driven outwards in direction D6, into apertures 174', thereby dislodging any engagement portions 224' which had been resting therein. Notably, in this embodiment, the internal configuration does not interact with hinge 160' (not shown in FIGS. 10B-C). Instead, the hinge 160' is prevented from moving to its biased position (as seen in FIG. 5B) due to the coupling between the engagement portions 224' and the engagement assembly 172' and freed to move to its biased position when the engagement portions 224' are removed from apertures 174'.

Again referring generally to FIGS. 1-10C, subsequent to actuation of button 118, the button 118 and engagement assemblies 172, 172' may return to their original non-actuated and extended positions, respectively, but the toy doll 100 may remain in its second configuration C2. For example, in the embodiment shown in FIG. 10A, the biasing member 312 is a spring which biases the extendable member 176 and button 118 in their extended and non-actuated positions, respectively. However, biasing member 312 does not reset the hinge assembly 160 to its original position. Similarly, in the embodiment shown in FIGS. 10B-C, the internal members are not connected to hinge 160' and, thus, cannot reset hinge 160' to its original position. If the user desires to move the doll back to its first configuration C1, the user may rotate the softgoods portion about axis Al (see FIGS. 8A and 8B) in a direction D2 (see FIGS. 8A and 8B) until the softgoods portion is resting atop of tail 150. Then, the engagement portions 224, 224' may be wrapped around the tail 150 and secured on the engagement assembly 172, 172'. This process may be repeated as many times as desirable.

It is to be understood that a toy doll 100 may be fabricated from any suitable material, or combination of materials, such as plastic, foamed plastic, wood, cardboard, pressed paper, metal, supple natural or synthetic materials including, but not limited to, cotton, elastomers, polyester, plastic, rubber, derivatives thereof, and combinations thereof. Suitable plastics may include high-density polyethylene (HDPE), low-density polyethylene (LDPE), polystyrene, acrylonitrile butadiene styrene (ABS), polycarbonate, polyethylene terephthalate (PET), polypropylene, ethylene-vinyl acetate (EVA), or the like. Suitable foamed plastics may include expanded or extruded polystyrene, expanded or extruded polypropylene, EVA foam, derivatives thereof, and combinations thereof.

It is also to be understood that terms such as "left," "right," "top," "bottom," "front," "rear," "side," "height," "length," "width," "upper," "lower," "interior," "exterior," "inner," "outer" and the like as may be used herein, merely describe points or portions of reference and do not limit the present invention to any particular orientation or configuration. Further, the term "exemplary" is used herein to describe an example or illustration. Any embodiment described herein as exemplary is not to be construed as a preferred or advantageous embodiment, but rather as one example or illustration of a possible embodiment of the invention.

Although the disclosed inventions are illustrated and described herein as embodied in one or more specific examples, it is nevertheless not intended to be limited to the details shown, since various modifications and structural changes may be made therein without departing from the scope of the inventions and within the scope and range of equivalents of the claims. In addition, various features from one of the embodiments may be incorporated into another of the embodiments. Accordingly, it is appropriate that the appended claims be construed broadly and in a manner consistent with the scope of the disclosure as set forth in the following claims.

What is claimed is:

1. A toy doll, comprising:

a first portion including a trigger;

a garment with a first end and a second end, the first end being hingedly coupled to the first portion so that the garment is movable relative to the first portion between a first configuration and a second configuration and the second end including at least one engagement portion configured to releasably couple the garment to the first portion; and an engagement assembly movably coupled to the first portion and including a retractable rod that is movable between an engaged position and a disengaged position, wherein the at least one engagement portion included at the second end of the garment is coupleable to the engagement assembly to retain the garment in the first configuration when retractable rod is in the engaged position, and moving the retractable rod to the disengaged position causes the at least one engagement portion included at the second end of the garment to disengage from the engagement assembly and allows the garment to move to the second configuration, the retractable rod moving to the disengaged position upon actuation of the trigger.

2. The toy doll of claim 1, wherein the first portion comprises a body of a toy figure.

3. The toy doll of claim 1, wherein the first end of the garment comprises a softgoods portion coupled to the first portion and extending therefrom.

4. The toy doll of claim 1, wherein the garment further comprises:

a first side; and a second side, wherein the first side is displayed in the first configuration and the second side is displayed in the second configuration.

5. The toy doll of claim 4, wherein the first side includes a first pattern and the second side includes a second pattern.

6. The toy doll of claim 4, wherein the first portion includes a first subportion and a second subportion and the garment is configured to cover the second subportion in the first configuration and to cover the first subportion in the second configuration.

7. The toy doll of claim 6 wherein the second subportion is a tail.

8. The toy doll of claim 6 wherein the first subportion is a fin.

9. The toy doll of claim 6 wherein the first subportion and first side include a first pattern and the second subportion and the second side each include a second pattern.

10. The toy doll of claim 1, wherein the toy doll further comprises:

a hinge assembly that couples the first portion to the first end of the garment and biases the garment towards the second configuration regardless of the orientation of the toy doll.

11. The toy doll of claim 1, wherein the retractable rod extends into or through an aperture included in the first portion when in the disengaged position.

12. The toy doll of claim 1, wherein the retractable rod extends into or through an aperture included in the first portion when in the engaged position.

13. A toy doll comprising:

a body including a front portion and a back portion including a retractable rod;

a softgoods portion including a first end hingedly coupled to the body on the front portion of the body and a second end removably engaged to the body on the back portion, wherein the second end of the softgoods portion includes at least one engagement portion configured to removably engage the second end of the softgoods portion to the body when the retractable rod is in an engaged position; and a trigger included on the body, the trigger being configured to cause the retractable rod to move to a disengaged position and disengage the at least one engagement portion included at the second end of the softgoods portion from the back portion of the body, so that the softgoods portion moves from a first configuration to a second configuration.

14. The toy doll of claim 13, wherein the first end of the softgoods portion is hingedly coupled to the front portion of the body by a hinge assembly that is biased to move the softgoods portion to the second configuration regardless of the orientation of the toy doll.

15. The toy doll of claim 13, wherein the retractable rod is configured to disengage the at least one engagement portion included at the second end of the softgoods portion from the back portion of the body by moving from an extended position to a retracted position when the trigger is actuated.

16. The toy doll of claim 13, wherein the retractable rod is configured to disengage the at least one engagement portion included at the second end of the softgoods portion from the back portion of the body by moving from a retracted position to an extended position when the trigger is actuated.

17. A toy doll comprising:

a first portion including a trigger;

a garment including a first end and a second end, the first end being coupled to the first portion and movable relative to the first portion between a first configuration and a second configuration and the second end including at least one engagement portion configured to selectively engage the garment with the first portion;

an engagement assembly that is movably coupled to the first portion and includes a retractable rod that is movable between an engaged position and a disengaged position, wherein the at least one engagement portion is selectively engagable with the engagement assembly to retain the garment in the first configuration when the retractable rod is in the engaged position, and the retractable rod moves to the disengaged position upon actuation of the trigger; and a hinge assembly, the hinge assembly being biased to move the garment to the second configuration when the retractable rod is in the disengaged position and the garment is no longer retained in the first configuration by the engagement assembly.

18. The toy doll of claim 17, wherein the first portion comprises a body and the garment comprises a softgoods portion.

19. The toy doll of claim 17, wherein the retractable rod extends into or through an aperture included in the first portion when in the engaged position.

20. The toy doll of claim 17, wherein the retractable rod extends into or through an aperture included in the first portion when in the disengaged position.

* * * * *